United States Patent [19]

Johnson

[11] 4,008,817

[45] Feb. 22, 1977

[54] SAW BLADE HANDLING DEVICE

[75] Inventor: Robert L. Johnson, Calumet City, Ill.

[73] Assignee: United States Steel Corporation, Pittsburgh, Pa.

[22] Filed: Feb. 18, 1972

[21] Appl. No.: 227,477

[52] U.S. Cl. ..... 214/147 R; 294/81 R

[51] Int. Cl.[2] ..... B66C 1/00

[58] Field of Search ..... 214/1 BD, 1 QD, 147 R; 294/81, 93, 34

[56] References Cited

UNITED STATES PATENTS

| | | | |
|---|---|---|---|
| 2,900,090 | 8/1959 | Sack | 214/1 BD |
| 2,928,519 | 3/1960 | Finston | 214/1 BD |
| 3,055,695 | 9/1962 | Huff et al. | 294/81 |
| 3,154,338 | 10/1964 | Leach | 294/88 |

FOREIGN PATENTS OR APPLICATIONS

| | | | |
|---|---|---|---|
| 1,198,977 | 8/1965 | Germany | 214/1 BD |

*Primary Examiner*—Robert B. Reeves
*Assistant Examiner*—H. Grant Skaggs
*Attorney, Agent, or Firm*—Forest C. Sexton

[57] ABSTRACT

A handling device for a circular saw blade has a lifting rod slidably mounted in a vertical cylinder with its lower end extending downwardly from the cylinder. A saw blade support is pivotally mounted on the bottom of the rod with its top pivotally connected to one end of a link. The other end of the link is pivotally attached to the cylinder. With all parts vertical and the top of the cylinder supported by a crane the saw blade in vertical position can be secured to the saw blade support. To move the saw blade to a horizontal position the crane lowers the cylinder until the rod is in its upper position and the saw blade support is in a horizontal position. A locking pin arrangement is provided to lock the parts in this position so that the crane can move the saw blade in a horizontal position.

6 Claims, 5 Drawing Figures

SAW BLADE HANDLING DEVICE

This invention relates to a saw blade handling device and more particularly to a device for handling a circular saw blade which is to be swaged. The saw blades are normally stored in a vertical position but must be positioned horizontally on a vertical spindle for swaging. Since the saw blades weigh in the neighborhood of 600 lbs. this cannot be done manually. The saw blades are commonly positioned by inserting a saw blade lifting hook attached to a jib crane into dowel holes in the saw blade. The crane carries the saw blade in a vertical position to the saw blade swaging machine. A worker then takes hold of the lower edge of the blade and lifts it as a second worker lowers the blade by the jib crane. Thus, it is maneuvered over and onto the swaging machine spindle. This procedure is reversed in removing the blade from the machine. This operation in addition to being expensive because it requires two workers is also unsafe and difficult.

It is therefore an object of my invention to provide a device for handling saw blades or the like and moving the blade between horizontal and vertical positions in a safe manner.

Another object is to provide such a device which can be operated by one man.

These and other objects will be more apparent after referring to the following specification and attached drawings, in which.

Figure 1:
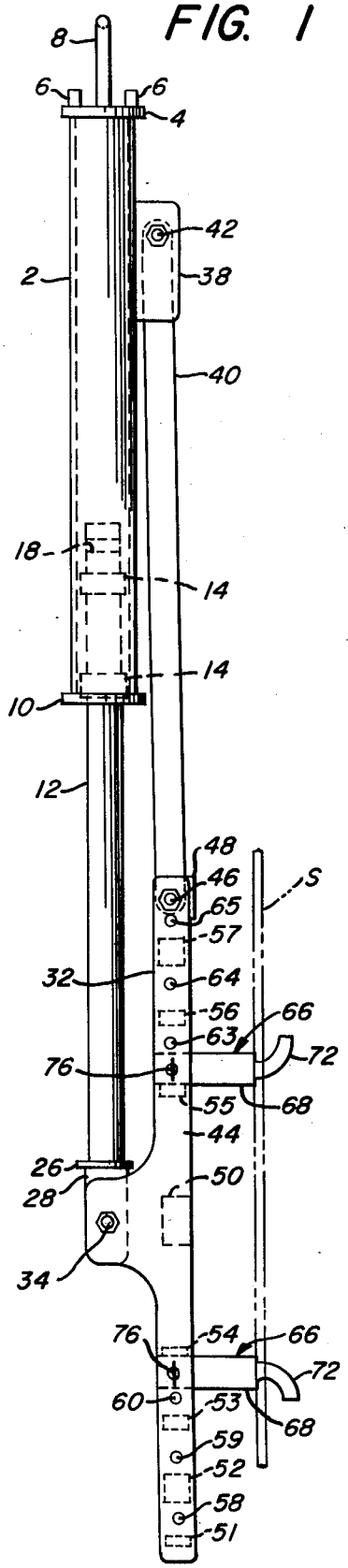
FIG. 1 is an elevation of the device of my invention with a saw blade supported thereby in vertical position.
Figure 2:
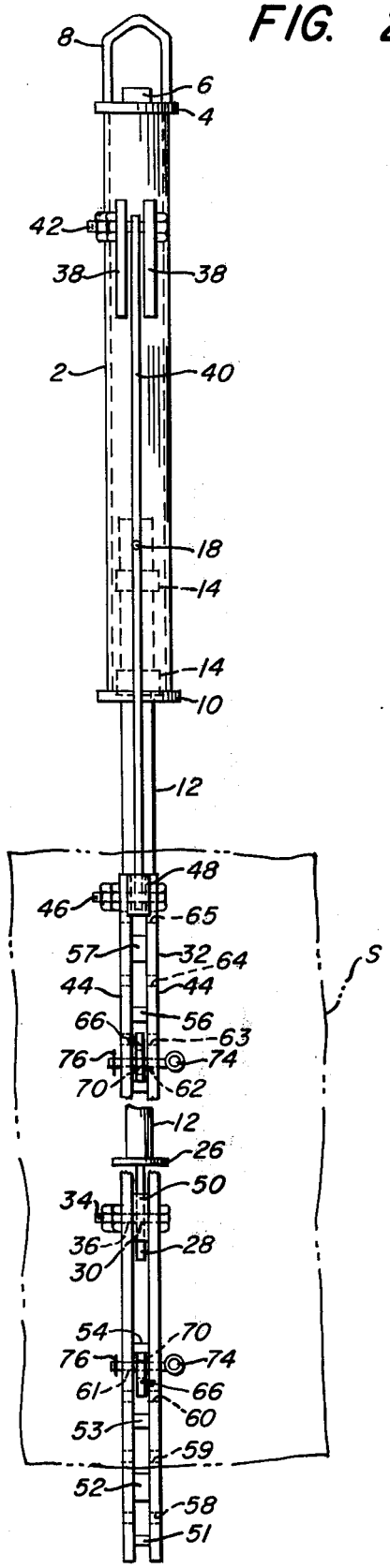
FIG. 2 is a side elevation of FIG. 1.

Referring more particularly to the drawings, reference numeral 2 indicates a cylinder having a ring 4 welded to the top thereof. A pair of flanges 6 are welded to the top of ring 4 in spaced apart relationship. A lifting bail 8 is also welded to the top of ring 4. A ring 10 is welded to the bottom of cylinder 2. A lifting rod 12 having a pair of vertically spaced rings 14 welded to the top portion thereof is slidably mounted in the cylinder 2. While the rod 12 is shown as solid, it is preferred that it be made of a tube to decrease its weight. The rings 14 fit snugly in the cylinder 2. The central openings in rings 4 and 10 have a diameter slightly greater than the diameter of rod 12, but less than the outside diameter of rings 14. Thus, the rod 12 can slide in cylinder 2 between an upper position (FIG. 3) where the upper ring 14 contacts ring 4 and a lower position where the lower ring 14 contacts ring 10 (FIGS. 1 and 2). The top of rod 12 has a hole 18 extending therethrough. The rod 12 can be held in its upper position by passing a locking pin 20 through hole 18 with the pin bearing on top of flanges 6. A cotter pin 22 may be passed through a hole in pin 20 to confine the pin in hole 18 between cotter pin 22 and head 24 of pin 20. A T-member 26 is welded to the bottom of rod 12 with its leg 28 extending downwardly. A horizontal hole 30 is provided in leg 28. A blade support 32 is pivotally attached to rod 12 by means of a bolt 34 passing through hole 30 and aligned holes 36 in support 32. A pair of spaced apart vertical brackets 38 are welded to the outside of cylinder 2 a short distance below the top thereof. A link 40 has its upper end positioned between brackets 38 and is pivotally secured thereto by means of a bolt 42 passing through aligned holes in the brackets 38 and link 40. Support 32 is fabricated from two spaced apart plates 44 with the lower end of link 40 being positioned therebetween. The link 40 is pivotally secured to plates 44 by means of a bolt 46 passing through aligned holes in the link 40 and plates 44. The plates 44 are held in spaced apart assembled relationship by means of plates 48, 50, 51, 52, 53, 54, 55, 56 and 57 extending between and welded thereto. Pairs of aligned holes 58, 59, 60, 61, 62, 63, 64 and 65 are provided in plates 44. It will be seen that there are four pairs of holes on each side of holes 36 with the holes on one side being spaced from holes 36 the same distance as the holes on the other side.

A pair of lugs 66 are attached to blade support 32 at selected holes 58 to 65, depending upon the size of saw blade S to be handled. Each lug 66 has a rectangular base 68 with a hole 70 therethrough and a curved male projection 72 at its outer end. The plates 51 to 57 act as stops or guides for the base 68. To position the lugs 66 at holes 61 and 62, for example, the base 68 of a lug 66 is placed between plates 44 with its projection 72 facing upwardly, its base 68 resting on top of plate 57 and its hole 70 in alignment with holes 62. A locking pin 74 is then passed through aligned holes 62 and 70 and held in position by a cotter pin 76. In like manner a second lug 66 is positioned with its base 68 against the bottom of plate 54 and its hole 70 in alignment with holes 61. A second locking pin 74 is the passed through aligned holes 61 and 70 and held in position by a cotter pin 76. Lugs 66 can be engaged in any other of the holes 59 to 64 in a similar manner. When engaging lugs 66 in holes 61, 63 and 64 the top of base 68 will bear against the bottom of plates 54, 56 and 57, respectively. When engaging lugs 66 in the other holes the bottom of base 68 will rest on the adjacent plates 51, 52, 53, 55 and 65.

Figure 3:
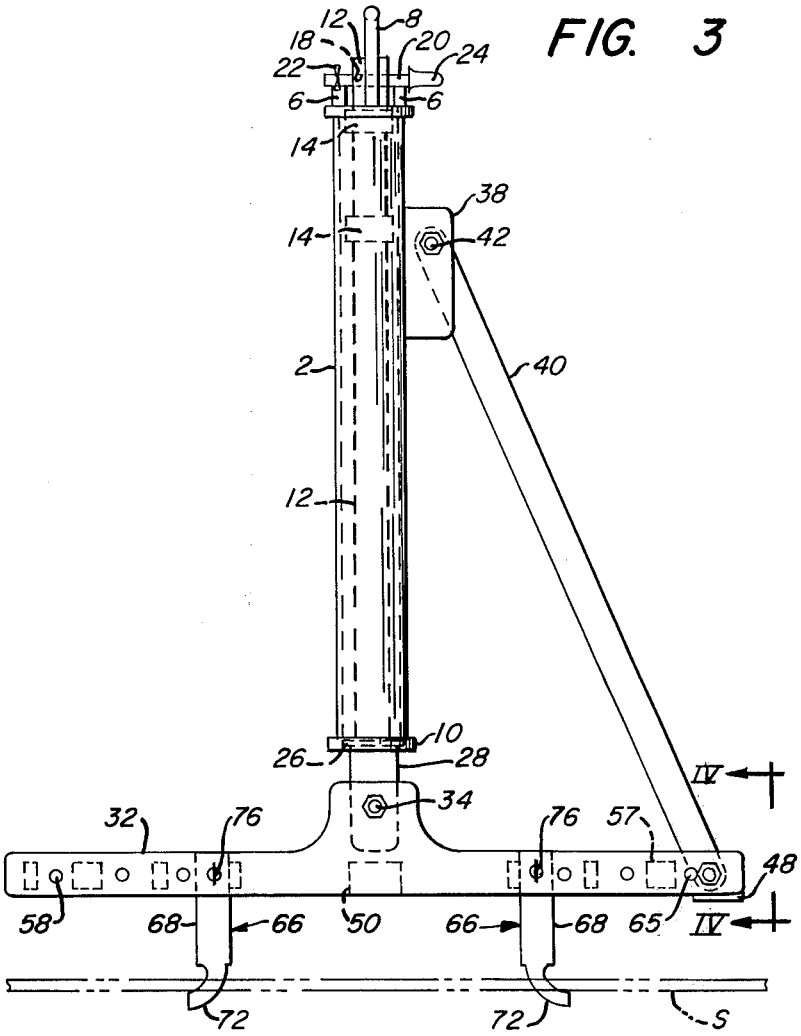
FIG. 3 is a view, similar to FIG. 1, but showing the position of the parts with the saw blade supported in a horizontal position.
Figure 5:
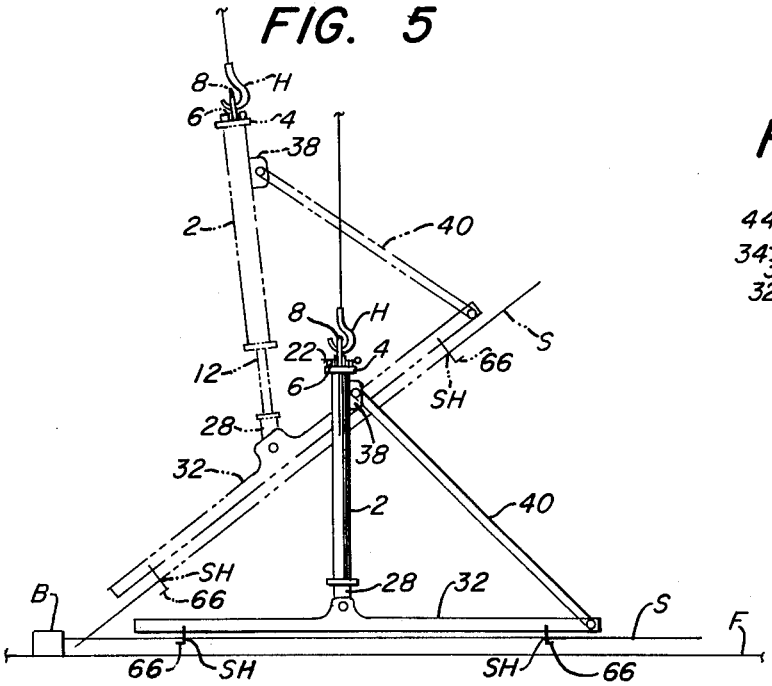
FIG. 5 is a view showing parts in different positions during handling of a saw blade.
Figure 4:
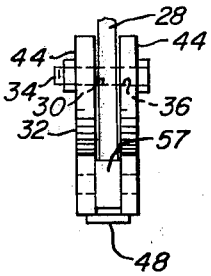
FIG. 4 is a view taken on the line IV—IV of FIG. 3 with parts removed.

In handling a saw blade S having diametrically opposed holes SH therein, a hook H(FIG. 5) secured to a jib crane (not shown) is positioned to engage the bail 8 and my device is raised off the floor. At this time no lugs 66 will be attached to blade support 32 which is in its vertical position. The blade S is rolled into position adjacent the support 32 and held in vertical position with its bottom resting on the floor F. The projection 72 of a lug 66 is then positioned in each of the holes SH in the blade and the lugs connected to holes 61 and 62 as described above. For different size blades different pairs of holes 58 to 65 are used to support the lugs 66. The saw blade is then raised from the floor and carried by the crane to the swaging machine. With the bottom edge of the saw blade B touching the floor F, the jib crane hook H is lowered causing the rod 12 to telescope into cylinder 2 until hole 18 in top of rod 12 is protruding above the top of flanges 6 as shown in FIG. 3. This movement causes support 32 to rotate about its axis to a horizontal position. The locking pin 20 is then inserted in hole 18 to lock the parts in position permitting the crane to position the saw blade on the swaging machine spindle. After the blade is swaged the saw blade is carried back to the saw blade rack and the saw blade S positioned against tipping block B as shown in full lines in FIG. 5. The pin 20 is then removed and the cylinder 2 raised to its top position to rotate the support 32 to its original vertical position. FIG. 5 shows in broken lines an intermediate position of the device during this movement. With the blade S resting on the floor in a vertical position the lugs 66 are removed.

While one embodiment of my invention has been shown and described, it will be apparent that other adaptations and modifications may be made without departing from the scope of the following claims.

I claim:

1. A handling device for a saw blade and the like having a pair of diametrically opposed holes therein, said device comprising a vertical cylinder, lifting means at the top of said cylinder, a lifting rod slidably mounted in said cylinder with its lower end extending below the bottom of said cylinder, a saw blade support, means pivotally connecting said support intermediate its length to the lower end of said rod for movement between horizontal and vertical positions, and a link having its upper end pivotally mounted on the outside of said cylinder and its lower end pivotally connected to the upper end of said saw blade support, said saw blade support having a pair of lugs extending generally normal therefrom one on each side of the pivot connection to said rod and adapted to engage in said diametrically opposed holes in the saw blade, including means for selectively mounting said lugs on said support various distances from the pivot connection to said rod, said lifting rod being movable between upper and lower positions, means limiting downward movement of said rod, and means for locking said rod in its upper position with said saw blade support being in its horizontal position.

2. A handling device according to claim 1 in which said means for locking said rod in its upper position includes a horizontal hole through said rod adjacent the top thereof, and a pin extending through said hole and bearing against the top of said cylinder.

3. A handling device according to claim 1 in which said means for selectively mounting said lugs to the support includes a pair of spaced apart elongated plates arranged normally in a vertical position, a plurality of pairs of aligned holes through said plates above and below the pivot connection to said rod, a pair of locking pins one adapted to be received selectively in a pair of said aligned holes above said pivot connection to said rod and the other adapted to be received selectively in a pair of said aligned holes below said pivot connection, a pair of lugs one mounted on each locking pin between said plates, and means preventing rotation of said lugs.

4. A handling device according to claim 3 in which each lug includes a curved male projection at its outer end adapted to engage in said diametrically opposed holes in said blade with the projection of the lower lug facing downwardly and the projection of the upper lug facing upwardly.

5. A handling device according to claim 4 in which each of said lugs includes a base positioned between said elongated plates and having a hole therein for receiving the associated locking pin, and said means preventing rotation of said lugs includes a plate extending between said elongated plates and spaced from its associated pair of aligned holes a distance slightly greater than the distance between the adjacent side of said lug base and the axis of the lug hole.

6. A handling device according to claim 5 in which said means for locking said rod in its upper position includes a horizontal hole through said rod adjacent the top thereof, and a pin extending through said hole and bearing against the top of said cylinder.

* * * * *